US010993495B2

(12) United States Patent
Heller

(10) Patent No.: US 10,993,495 B2
(45) Date of Patent: May 4, 2021

(54) HEADWEAR WITH TRANSPARENT VISOR PROVIDING ULTRAVIOLET RAY PROTECTION

(71) Applicant: Matt Heller, Basking Ridge, NJ (US)

(72) Inventor: Matt Heller, Basking Ridge, NJ (US)

( * ) Notice: Subject to any disclaimer, the term of this patent is extended or adjusted under 35 U.S.C. 154(b) by 0 days.

(21) Appl. No.: 16/656,488

(22) Filed: Oct. 17, 2019

(65) Prior Publication Data

US 2020/0121013 A1 Apr. 23, 2020

Related U.S. Application Data

(60) Provisional application No. 62/747,485, filed on Oct. 18, 2018.

(51) Int. Cl.
*A42B 1/205* (2021.01)
*A42B 1/004* (2021.01)
*A42B 1/0182* (2021.01)

(52) U.S. Cl.
CPC ..... *A42B 1/205* (2013.01); *A42B 1/004* (2013.01); *A42B 1/0182* (2021.01)

(58) Field of Classification Search
CPC ..... A42B 1/205; A42B 1/004; A42B 1/20; A42B 1/064; A42B 1/065
USPC ..... 2/175.1, 195.5, 10, 12, 15
See application file for complete search history.

(56) References Cited

U.S. PATENT DOCUMENTS 716,528 A * 12/1902 Maass ..... A42B 1/247 2/10
2,004,471 A * 6/1935 David ..... A42B 1/062 2/10
5,075,898 A * 12/1991 Bedient ..... A42B 1/065 2/10
5,896,587 A * 4/1999 Gentry ..... A42B 3/061 2/12
6,766,538 B2 7/2004 Park
7,082,618 B1 * 8/2006 Muso ..... A42B 1/062 2/175.1
7,707,648 B2 * 5/2010 Watabiki ..... A42B 3/227 2/10
9,578,913 B2 2/2017 Mcgoogan
2005/0132473 A1 6/2005 Upton et al.
(Continued)

FOREIGN PATENT DOCUMENTS

KR 200476643 Y1 3/2015
WO 2002082934 A1 10/2002

OTHER PUBLICATIONS

Written Opinion of the International Searching Authority, dated Jan. 10, 2020, or corresponding PCT Application No. PCT/US2019/057025, International Filing Date Oct. 18, 2019, consisting of 5 pages.

(Continued)

*Primary Examiner* — Katherine M Moran
(74) *Attorney, Agent, or Firm* — Gearhart Law LLC

(57) ABSTRACT

A headwear apparatus is provided. The headwear apparatus including a cap configured to be worn on a head of a user, and a visor coupled to the cap, wherein at least a portion of the visor is transparent in at least one direction, and wherein the visor is configured to block a portion of ultraviolet (UV) rays from passing through the visor. The visor may be permanently affixed to the cap or may be removably coupled to the cap.

18 Claims, 21 Drawing Sheets

(56) References Cited

U.S. PATENT DOCUMENTS

| | | | | |
|---|---|---|---|---|
| 2007/0067887 | A1* | 3/2007 | Lee | A42B 3/227 2/12 |
| 2011/0067168 | A1* | 3/2011 | Steiner | A42B 1/062 2/209.13 |
| 2011/0234403 | A1* | 9/2011 | Niederer, III | A42B 3/227 340/540 |
| 2015/0047099 | A1 | 2/2015 | Koh | |
| 2015/0082521 | A1* | 3/2015 | Hassan | A42B 3/061 2/413 |
| 2015/0132473 | A1* | 5/2015 | Petkie | H01L 35/34 427/58 |
| 2015/0135406 | A1* | 5/2015 | Nguyen | A42B 1/205 2/209.12 |
| 2015/0296915 | A1 | 10/2015 | Roppatte | |
| 2016/0128416 | A1* | 5/2016 | Kim | A42B 3/227 2/195.1 |
| 2016/0219961 | A1 | 8/2016 | Campos | |
| 2017/0072774 | A1 | 3/2017 | Kim et al. | |
| 2018/0146734 | A1 | 5/2018 | Kelly | |

OTHER PUBLICATIONS

International Search Report, dated Jan. 10, 2020, or corresponding PCT Application No. PCT/US2019/057025, International Filing Date Oct. 18, 2019, consisting of 2 pages.

"I Know Football," Under Armour Hologram Visor Review, Episode 157, YouTube, Apr. 25, 2014, Retrieved on Nov. 27, 2019 from: https://www.youtube.com/watch?v=913gcjQRSag.

* cited by examiner

135

135

HEADWEAR WITH TRANSPARENT VISOR PROVIDING ULTRAVIOLET RAY PROTECTION

CROSS-REFERENCE TO RELATED APPLICATIONS

This application is a U.S. Non-Provisional Patent Application that claims priority to U.S. Provisional Application Ser. 62/747,485 filed on Oct. 18, 2018, the entire contents of which are hereby incorporated by reference.

FIELD OF THE EMBODIMENTS

This invention relates to headwear and, in particular, to headwear including a transparent, ultraviolet (UV)-protecting visor.

BACKGROUND OF THE EMBODIMENTS

There are multiple types of headwear that incorporate visors, which include baseball caps and sports visors. This type of headgear can be used to block sunlight (including UV rays), as part of a uniform (such as in baseball), as a fashion statement, and/or to support an organization or sports team. For these reasons, visors are often seen in sports arenas.

While blocking sunlight has its benefits, this type of headwear typically has opaque visors, making the wearer unable to see anything being blocked by the visor. For baseball cap wearers at a baseball game, this may prevent the wearer from being adequately able to see any airborne baseballs that may be nearby, which may cause injury.

For at least these reasons, headwear is needed that includes a visor that blocks dangerous or distracting light (including UV rays) while still being transparent enough to enable a wearer to have a full field of vision.

Examples of related art are described below:

U.S. Pat. No. 6,766,538 generally describes a brim or visor for hats which includes a brim cover and a brim insert securely affixed within the brim cover. The brim cover comprises an upper sheet having an image printed to one side thereof; and a lower sheet attached to the upper sheet to form a pocket adapted to receive the brim insert. The brim insert is securely affixed within the pocket such that the image printed on the upper sheet lays substantially flat over the brim insert.

U.S. Pat. No. 9,578,913 generally describes a toboggan style hat that includes a removable visor, as well as novel means for removable attachment thereto. In a preferred embodiment, the visor member includes a pair of arms that extend rearwardly from the bill, and the hat includes a pair of holes on an underside thereof. Each hole serves as an opening for an inner sleeve, so that when a user wishes to attach the visor to the hat, the arms of the visor slide into the holes and along the inside of the sleeves in order to properly position the visor with respect to the hat and face. In one embodiment, a series of snaps are positioned on an outer portion of the visor, and correspond with a series of snaps that are positioned on an inner portion of the hat.

U.S. Patent Publication No. 2015/0047099 generally describes a hair band-UV protection sun visor includes an outer band and an inner band, a visor unit coupled to the band unit to be rotatable on the band unit, and a cap side coupling device that couples the band unit and the visor unit. The cap side coupling device includes a circular coupler and a latch coupler, the circular coupler is fixedly coupled to the visor unit and the latch coupler is fixedly coupled to the band unit, and the circular coupler visor unit is rotated or fixed on the latch coupler band unit.

U.S. Patent Publication No. 2015/0296915 generally describes a convertible headwear that converts from a single piece of headwear to a separate visor and a separate skullcap. The invention also provides a removable sweat band within the visor. The headwear and its components are attached by fasteners which may be zippers, hook and loop fasteners, snaps, buttons, or other common fastening means. The headwear can be a cap or any style of hat.

U.S. Patent Publication No. 2016/0219961 generally describes a device that will consist of two visors attached to a frame that will connect directly to any type of hoodie or like shape device.

U.S. Patent Publication No. 2017/0072774 generally describes a light filtering transparent or semitransparent visor intended to prevent flash blindness and other hazards associated with the adverse effects associated with bright lights impacting the eyesight of occupants of a vehicle. In the certain embodiments, the visor comprises a heavily tinted body intended to filter the bright rays of sun to enable safe viewing of the sun through the filter. Embodiments of the apparatus are designed to be repositioned directly in the line of sight between the viewer and the sun.

None of the art described above addresses all of the issues that the present invention does.

SUMMARY OF THE EMBODIMENTS

According to an aspect of the present invention, a headwear apparatus is provided. The headwear apparatus including a cap configured to be worn on a head of a user, and a visor coupled to the cap, wherein at least a portion of the visor is transparent in at least one direction, and wherein the visor is configured to block a portion of ultraviolet (UV) rays from passing through the visor.

It is an object of the present invention to provide the headwear apparatus, wherein the visor is permanently affixed to the cap.

It is an object of the present invention to provide the headwear apparatus, wherein the visor further includes a tinting material, causing the visor to partially or completely block various wavelengths of light, prevent and reduce glare, and improve or expand the wearer's vision.

It is an object of the present invention to provide the headwear apparatus, wherein the tinting material is further configured to alter a tint of the visor according to an intensity of light hitting the visor.

It is an object of the present invention to provide the headwear apparatus, wherein a portion of the visor is not transparent.

It is an object of the present invention to provide the headwear apparatus, wherein the apparatus further includes a graphic coupled to the visor.

It is an object of the present invention to provide the headwear apparatus, wherein the graphic is transparent.

It is an object of the present invention to provide the headwear apparatus, wherein a top surface of the visor has a mirrored finish.

It is an object of the present invention to provide the headwear apparatus, wherein the visor includes optical-grade polycarbonate.

According to another aspect of the present invention, a headwear apparatus is provided. The headwear apparatus includes a cap configured to be worn on a head of a user, and a removable visor coupled to the cap, wherein at least a portion of the visor is transparent in at least one direction, and wherein the visor is configured to block a portion of ultraviolet (UV) rays from passing through the visor.

It is an object of the present invention to provide the headwear apparatus, wherein the visor is removably secured to the cap using one or more securing mechanisms.

It is an object of the present invention to provide the headwear apparatus, wherein the securing mechanisms are selected from the group consisting of: hook and loop fasteners, snaps, male and female snaps, molded snaps, screws, clips, buttons, pressure-fit systems, slot and tab-type systems, and magnetic systems.

It is an object of the present invention to provide the magnetic systems that include one or more magnetic strips and one or more individualized magnets.

It is an object of the present invention to provide the headwear apparatus, wherein the visor further includes a tinting material, causing the visor to lighten, darken, and/or change between a variety of colors.

It is an object of the present invention to provide the headwear apparatus, wherein the tinting material is further configured to adjust an amount of the visor's tint darker or lighter, according to an intensity of light coming into contact with the visor.

It is an object of the present invention to provide the headwear apparatus, wherein a portion of the visor is not transparent.

It is an object of the present invention to provide the headwear apparatus, wherein the headwear apparatus further includes a graphic coupled to the visor.

It is an object of the present invention to provide the headwear apparatus, wherein the graphic is transparent.

It is an object of the present invention to provide the headwear apparatus, wherein a top surface of the visor has a mirrored finish.

It is an object of the present invention to provide the headwear apparatus, wherein the visor includes optical-grade polycarbonate.

It is an object of the present invention to provide the headwear apparatus, wherein only a portion of the visor is removable.

DESCRIPTION OF THE PREFERRED EMBODIMENTS

Figure 1:
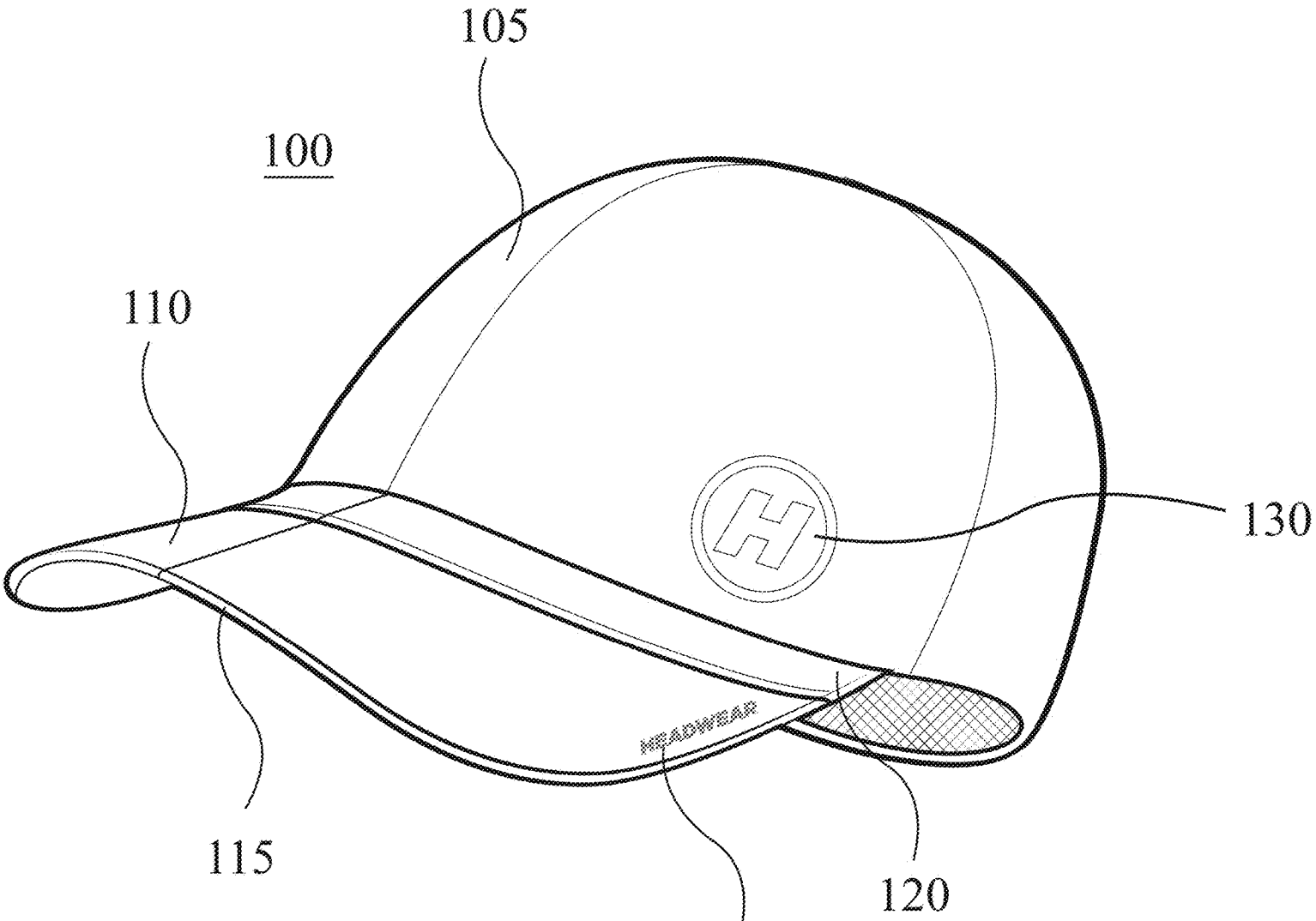
FIG. 1 shows a perspective view of a headwear apparatus, according to an embodiment of the invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Referring now to FIG. 1, a perspective view of a headwear apparatus 100 is illustratively depicted, in accordance with an embodiment of the present invention.

Figure 2A:
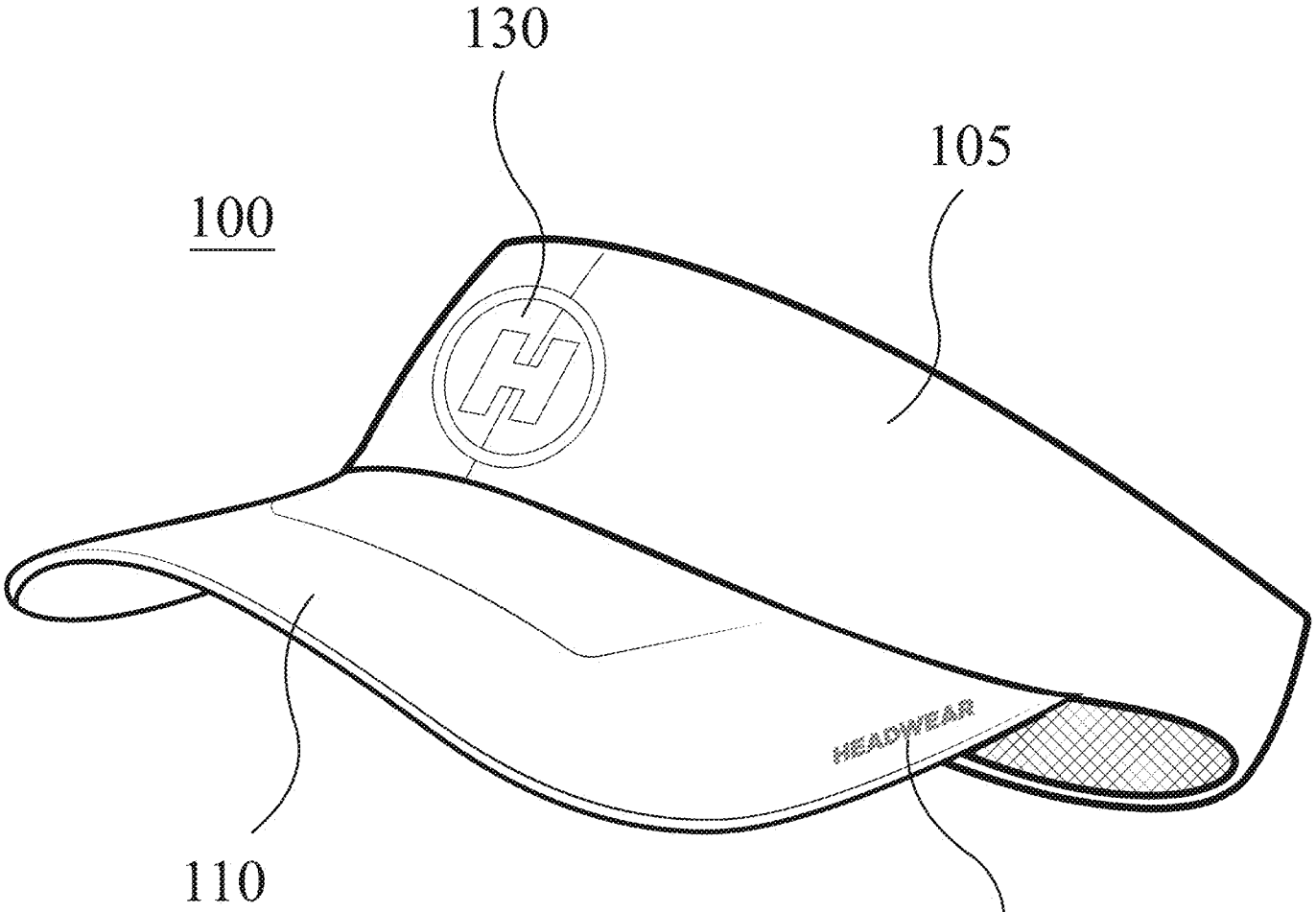
FIG. 2A-FIG. 2B show perspective views of a headwear apparatus having an open top (FIG. 2A) and a closed top (FIG. 2B), according to embodiments of the present invention.
Figure 2B:
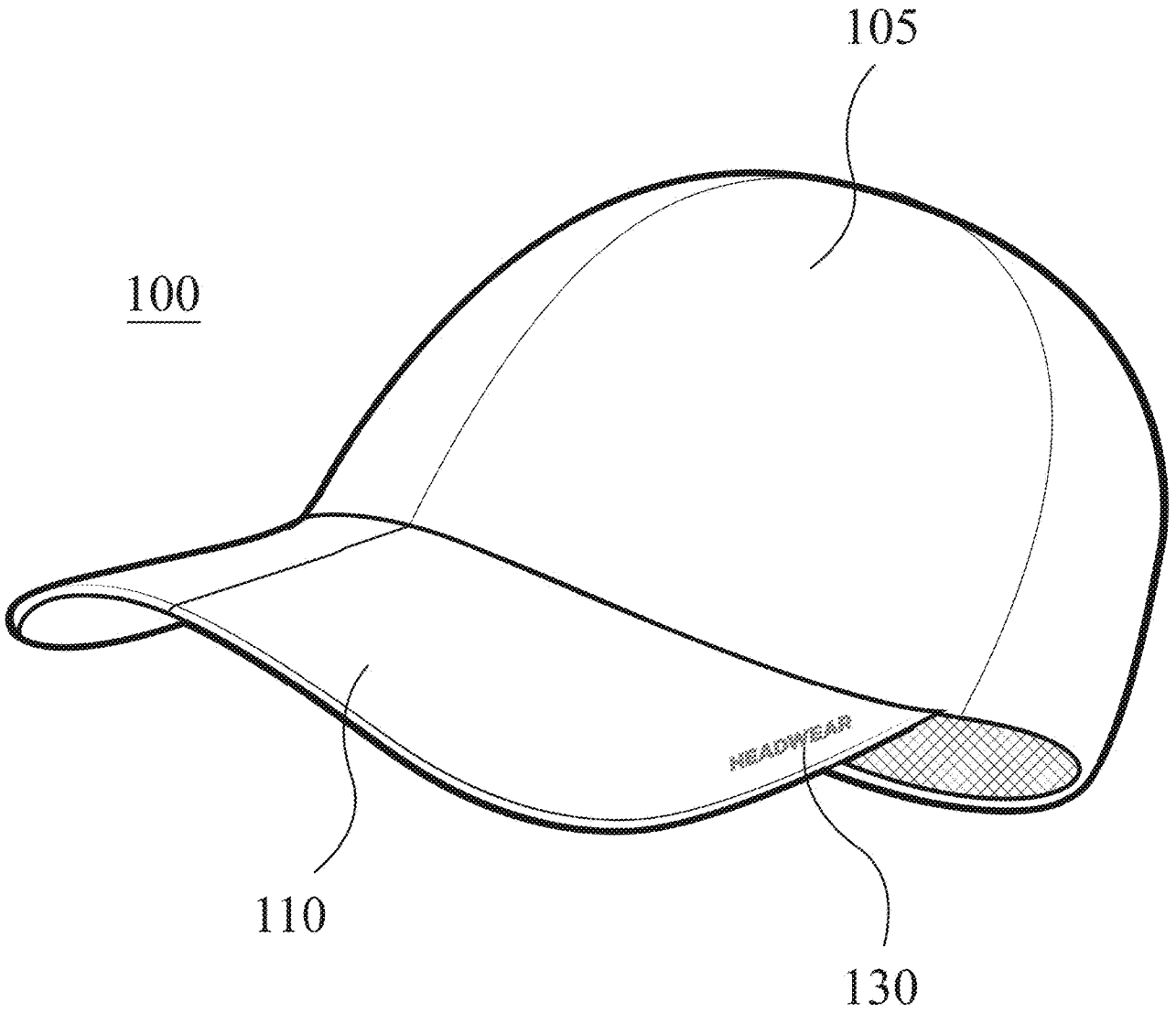

According to an embodiment, the headwear apparatus 100 includes a cap 105 and a visor 110. According to an embodiment, the cap 105 may be closed (as shown in FIG. 1 and FIG. 2B) or open, similar to a sports visor, as shown in FIG. 2A. According to an embodiment, the cap 105 is configured to be worn on the head of a user. According to an embodiment, the visor 110 is coupled to a front portion of the cap 105. According to an embodiment, the cap 105 and the visor 110 form a baseball cap (as shown in FIG. 1). It is noted, however, that the cap 105 and the visor 110 may form any suitable type of headwear having visors (such as, but not limited to, a sports visor, as shown in FIG. 2A), while maintaining the spirit of the present invention.

According to an embodiment, at least a portion of the visor 110 is transparent in at least one direction. According to an embodiment, at least a portion of the visor 110 is translucent in at least one direction. According to an embodiment, the visor 110 includes an optical-grade polycarbonate. It is noted, however, that the visor may include other suitable transparent materials, while maintaining the spirit of the present invention.

According to an embodiment, the visor 110 includes one or more materials configured to prevent all or some ultraviolet (UV) rays from passing through the visor 110. According to an embodiment, the visor 110 includes one or more materials configured to entirely or partially block glare from the eyesight of the wearer of the headwear apparatus 100. According to an embodiment, the visor 110 includes one or more materials configured to alter the transparency and/or the translucency of the visor 110. According to an embodiment, the transparency and/or translucency of the visor 110 may not be the same on every portion of the visor 110.

According to an embodiment, the visor 110 includes one or more tinting materials 115 configured to tint the visor 110, causing the visor's 110 tint to increase. According to an embodiment, the tinting material 115 is a photochromic tinting material, configured to lighten and/or darken the tint of the visor 110, according to an intensity of light hitting the visor 110. For example, the stronger the light that hits the tinting material 115, the more significant the tint of the visor 110. According to an embodiment, the visor 110 includes an optical-grade polycarbonate. According to an embodiment, the one or more tinting materials 115 may further cause the visor 110 to change between a variety of colors. According to an embodiment of the present invention, the one or more tinting materials 115 may alter an opacity of the visor 110.

Figure 7A:
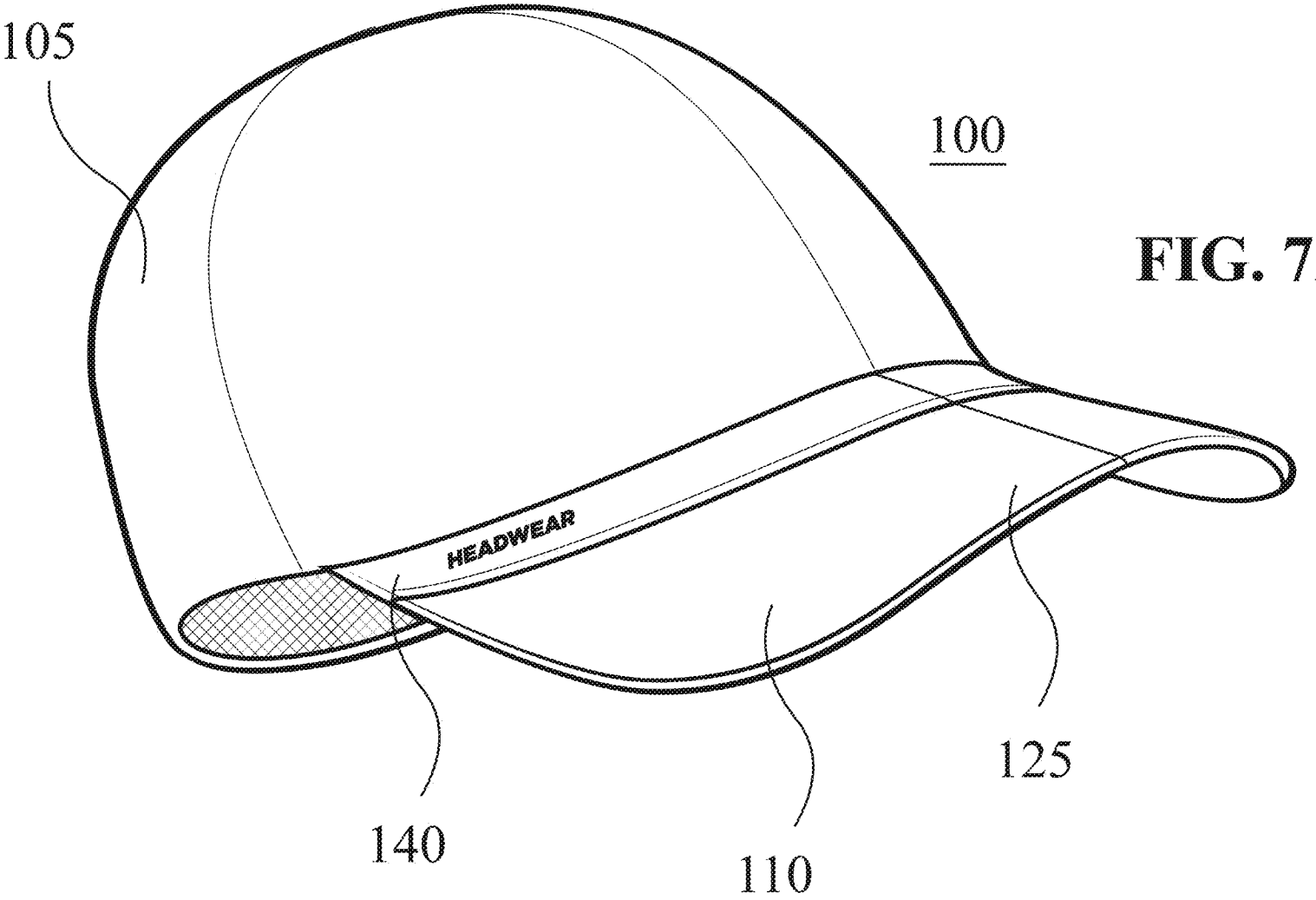
FIG. 7A-FIG. 7E show a perspective view (FIG. 7A) and an exploded perspective view (FIG. 7B, FIG. 7C, FIG. 7D, and FIG. 7E) of a headwear apparatus having a removable visor, according to an embodiment of the present invention.
Figure 7B:
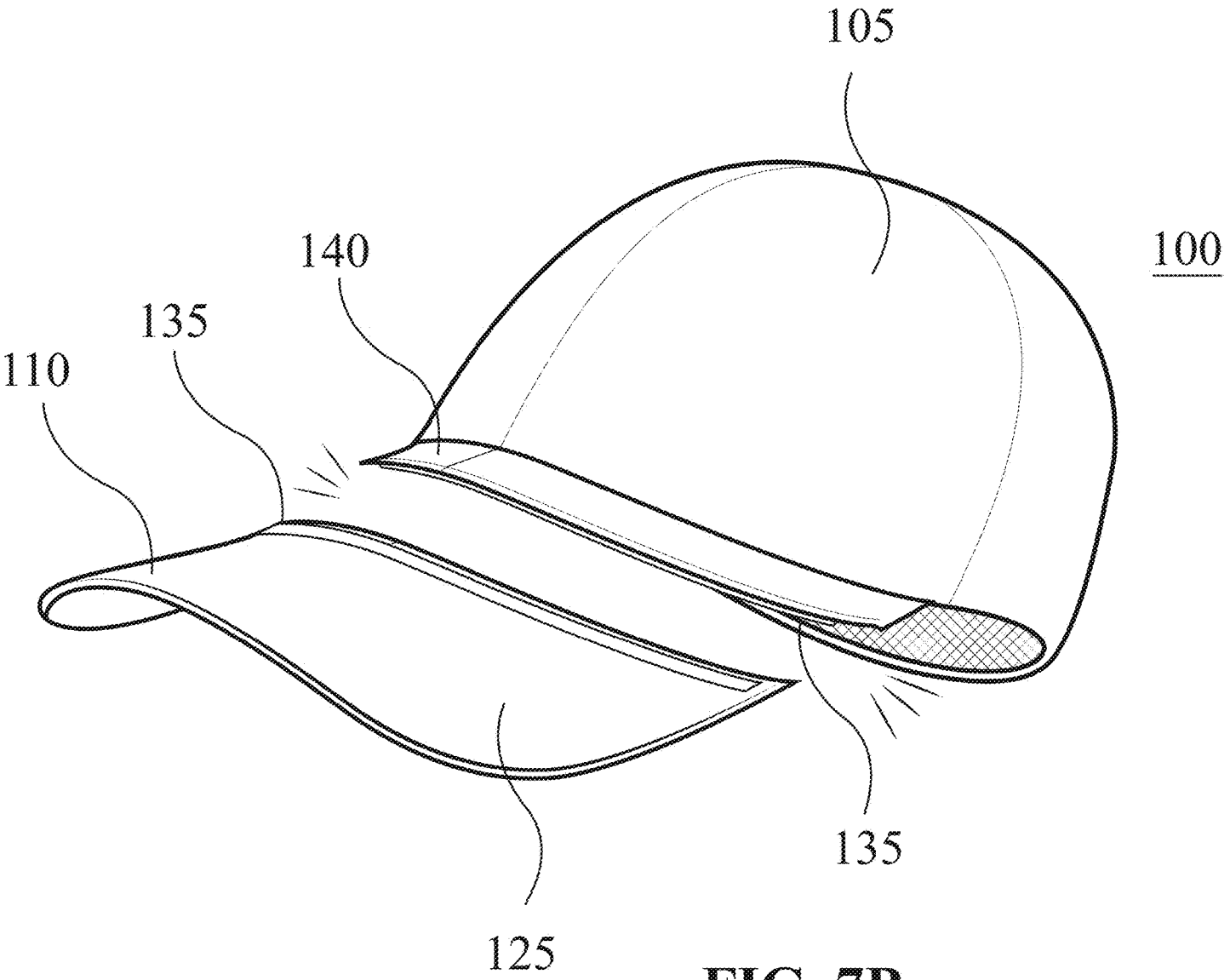

According to an embodiment, the tinting material 115 is incorporated into the visor 110. According to an embodiment, the tinting material 115 is a film adhered to the visor 110. It is noted, however, that other suitable means of applying the tinting material 115 may also be used, while maintaining the spirit of the present invention. According to an embodiment, a portion 120 of the visor 110 is not transparent. According to an embodiment, one or more sections of the visor 110 may not be translucent. According to an embodiment, a top surface of the visor 110 has a mirrored surface 125 (as shown in FIG. 7A and FIG. 7B).

According to an embodiment, the visor may include one or more graphics 130 (e.g., a logo, a symbol, a pattern, etc.). According to an embodiment, the graphics 130 may include transparent and/or opaque materials and/or materials of various lighter or darker tints. The graphics 130 may also be positioned on the cap 105 and/or the visor 110. According to an embodiment, the one or more graphics 130 are flush with the visor 110. According to an embodiment, the one or more graphics 130 are secured to a surface of the visor 110.

Figure 3:
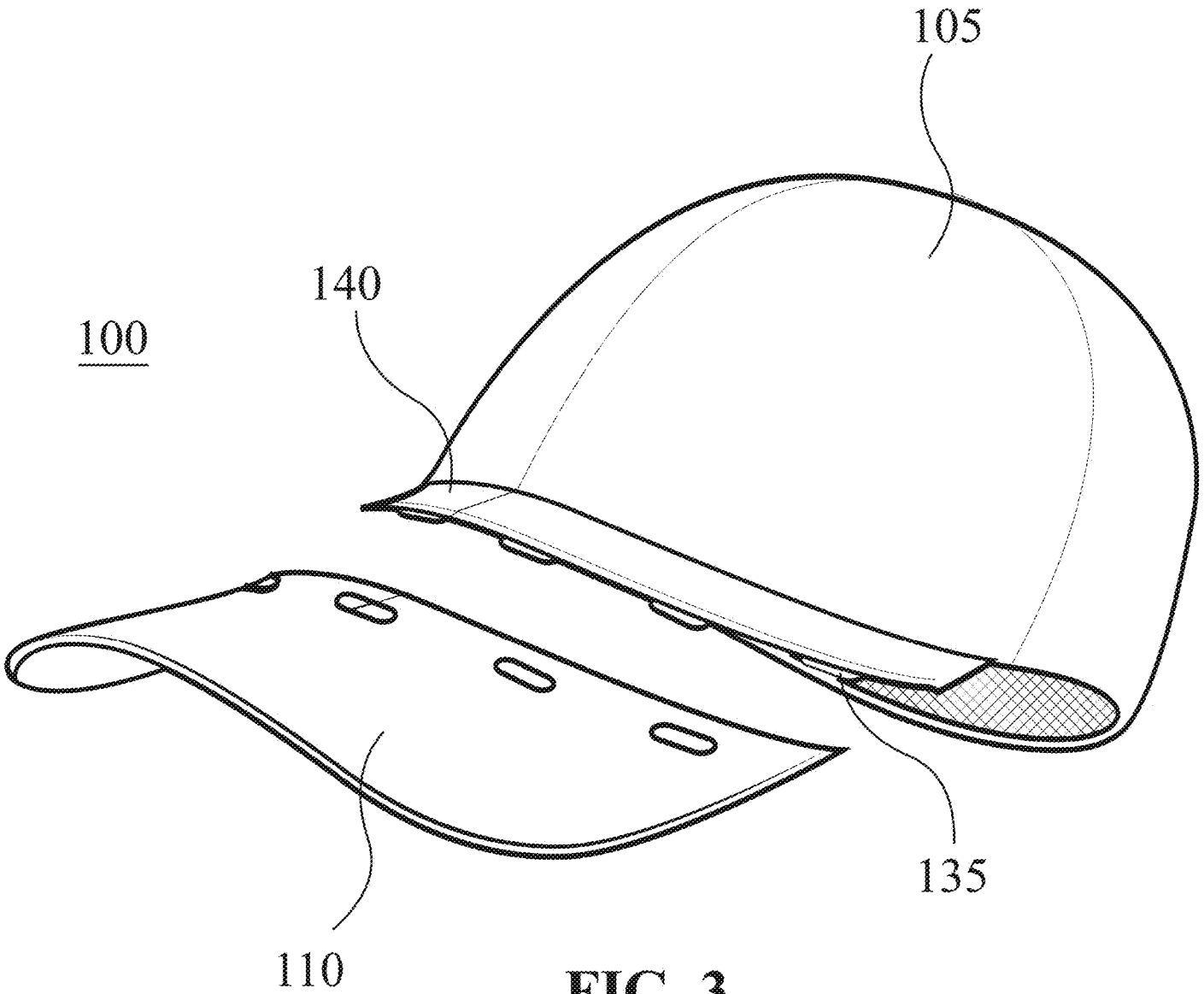
FIG. 3 shows an exploded perspective view of a headwear apparatus having a removable visor, according to an embodiment of the present invention.

Referring now to FIG. 3, an exploded view of a headwear apparatus 100 having a removable visor 110 is illustratively depicted, in accordance with an embodiment of the present invention.

Figure 4B:
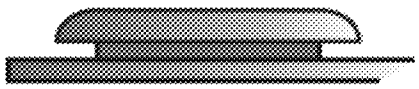
FIG. 4A-FIG. 4B show a perspective view (FIG. 4A) and a side view (FIG. 4B) of a snap-fit locking mechanism, according to an embodiment of the present invention.
Figure 4A:
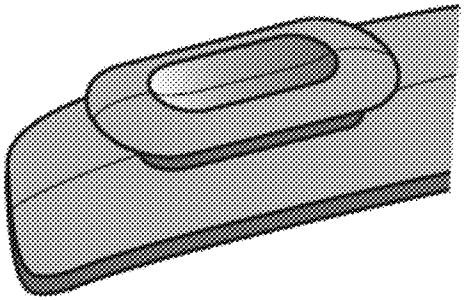
Figure 4C:
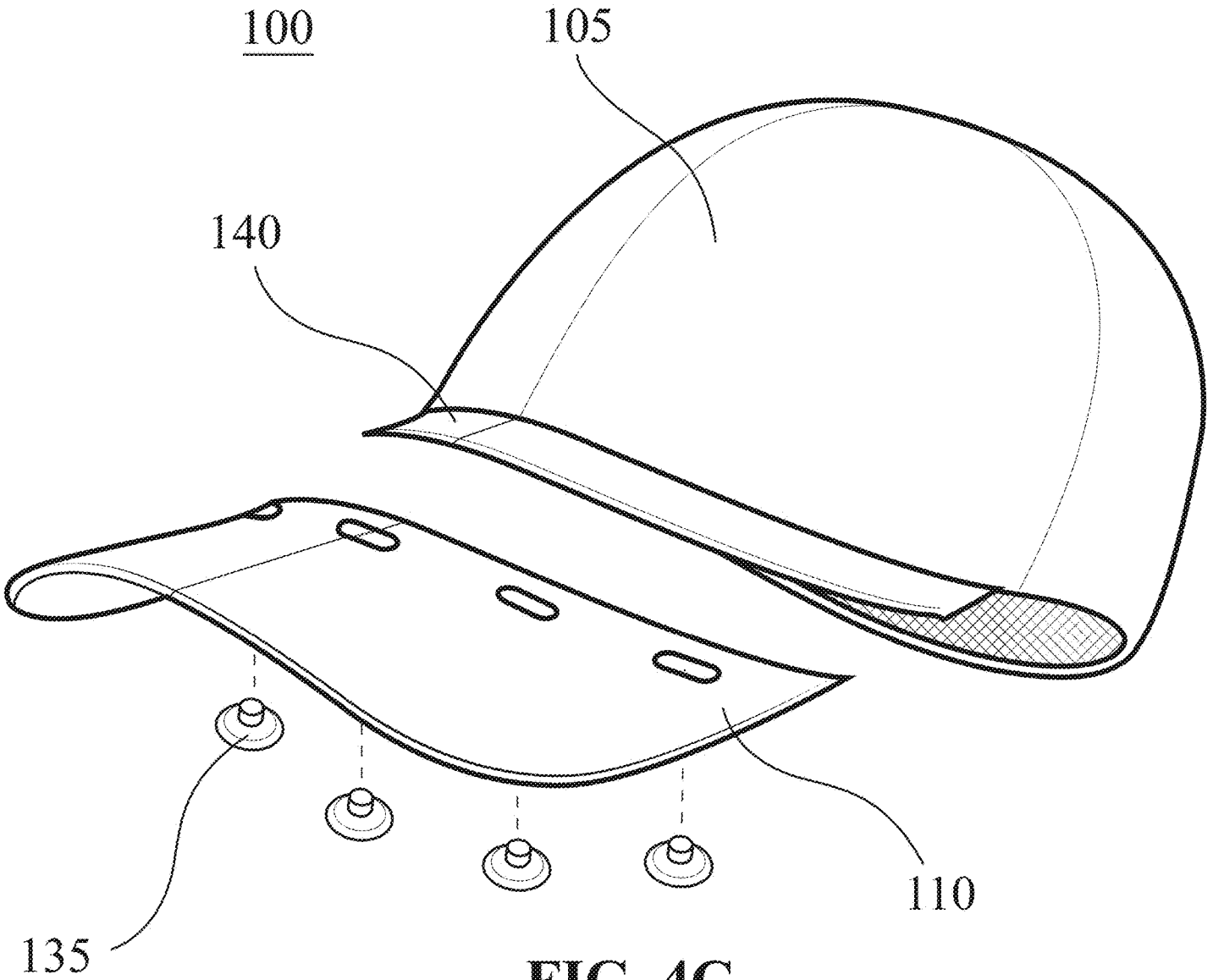
FIG. 4C-FIG. 4D show a perspective view of a fastener locking mechanism from below (FIG. 4C) and a perspective view of a fastener locking mechanism from above (FIG. 4D), according to an embodiment of the present invention.
Figure 4D:
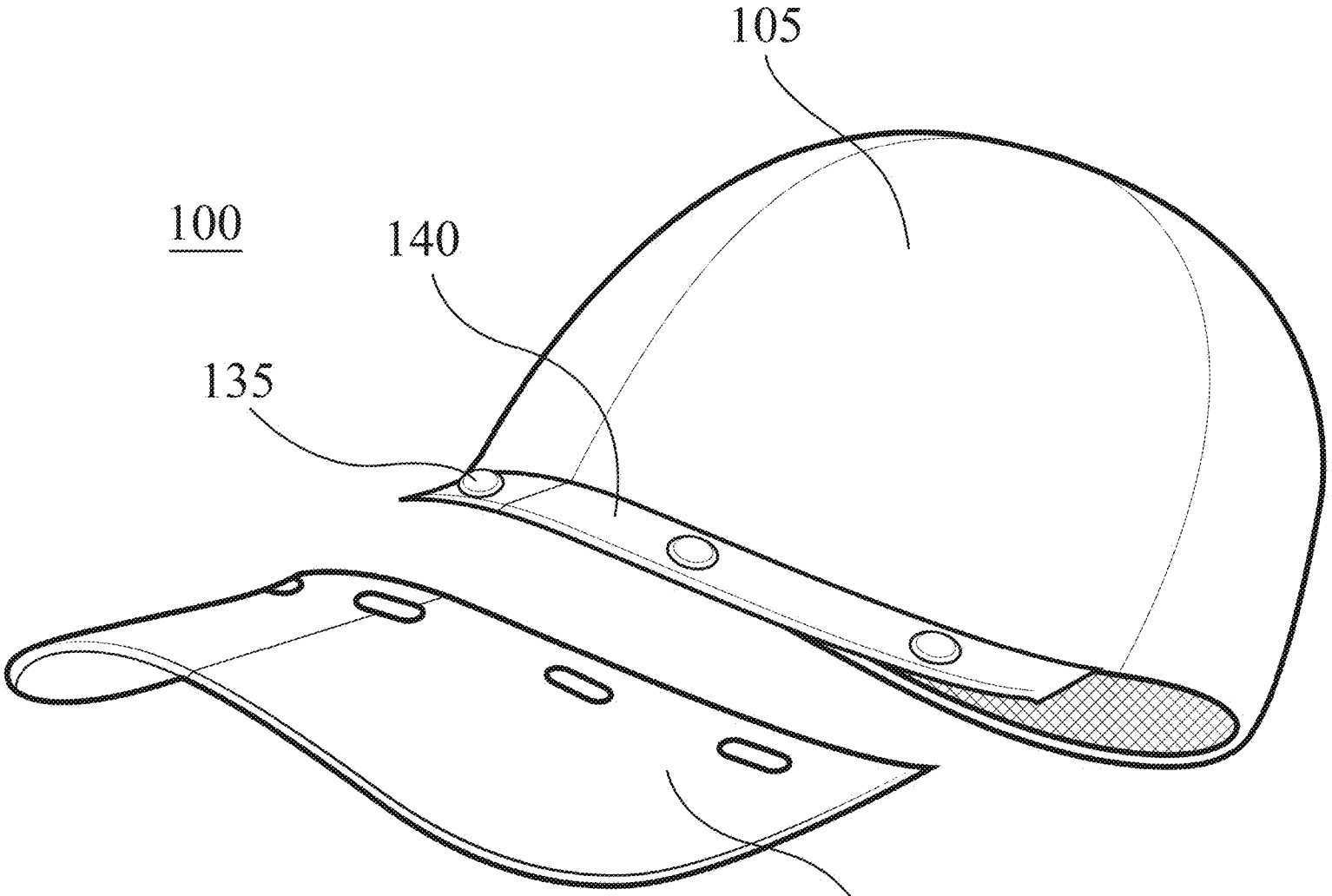
Figure 5A:
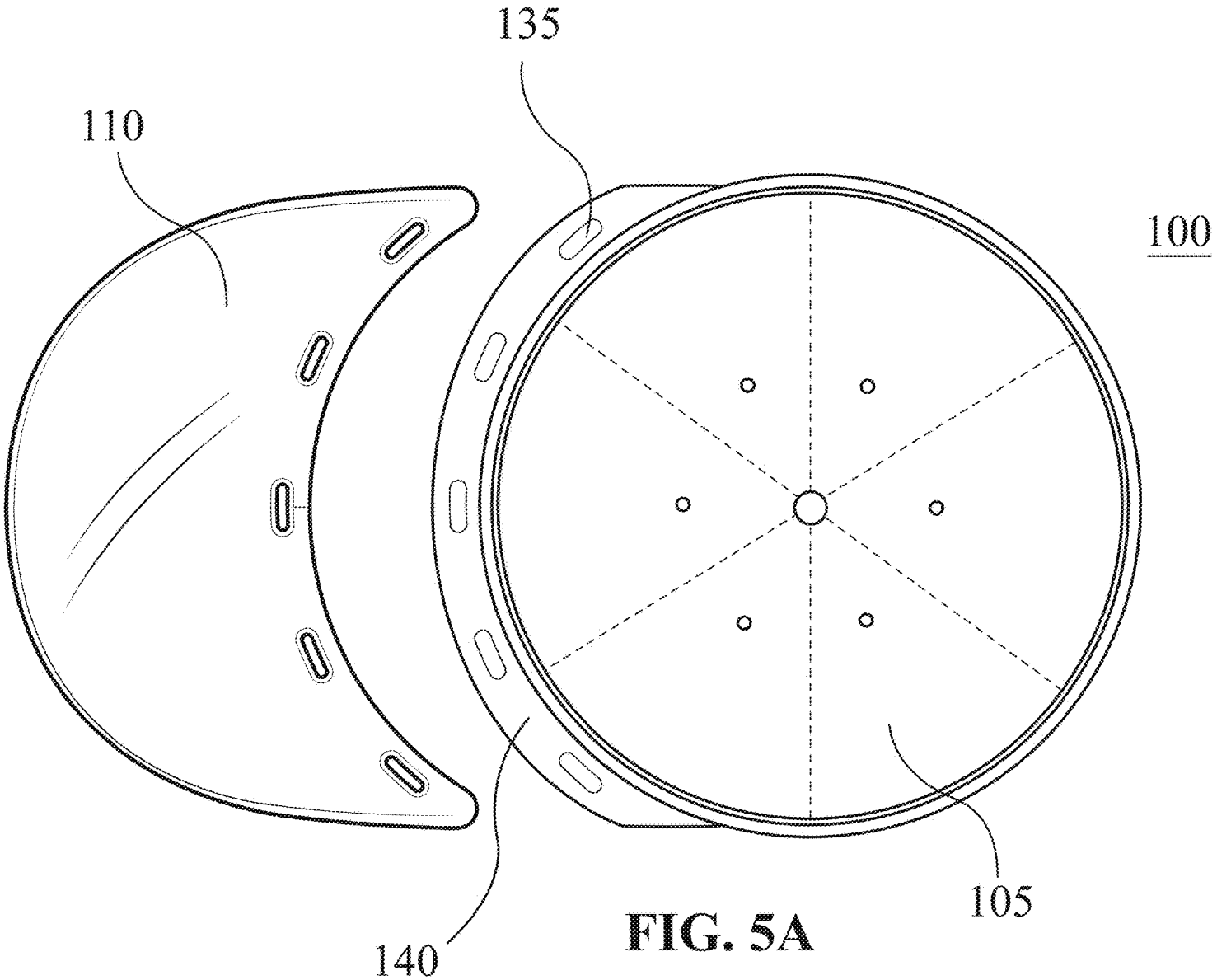
FIG. 5A-FIG. 5B show an exploded bottom view (FIG. 5A) and a bottom view (FIG. 5B) of a headwear apparatus having a removable visor, according to an embodiment of the present invention.
Figure 5B:
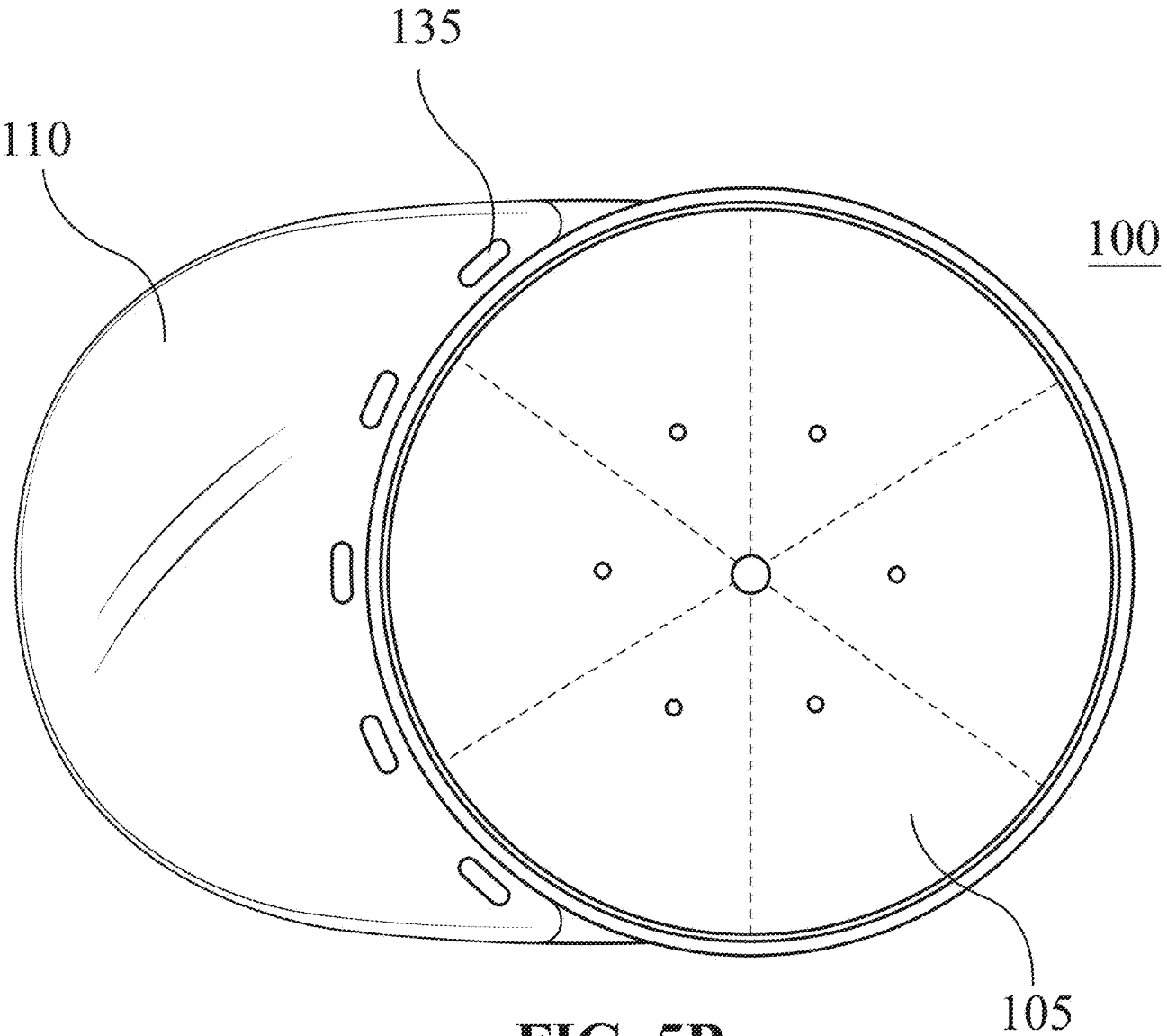
Figure 6A:
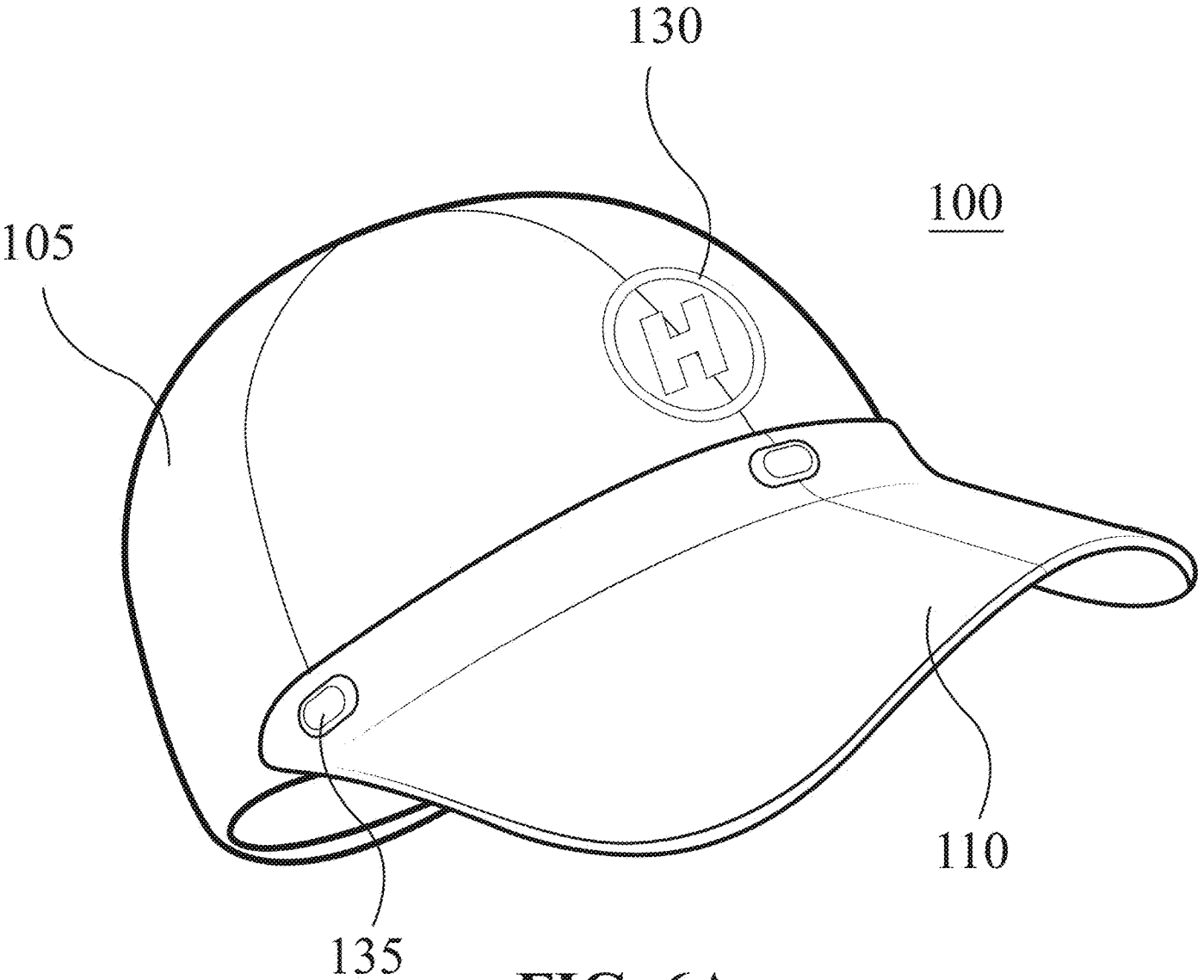
FIG. 6A-FIG. 6G show a perspective view (FIG. 6A) and an exploded perspective view (FIG. 6B, FIG. 6C, FIG. 6D, FIG. 6E, FIG. 6F, and FIG. 6G) of a headwear apparatus having a removable visor, according to an embodiment of the present invention.
Figure 6B:
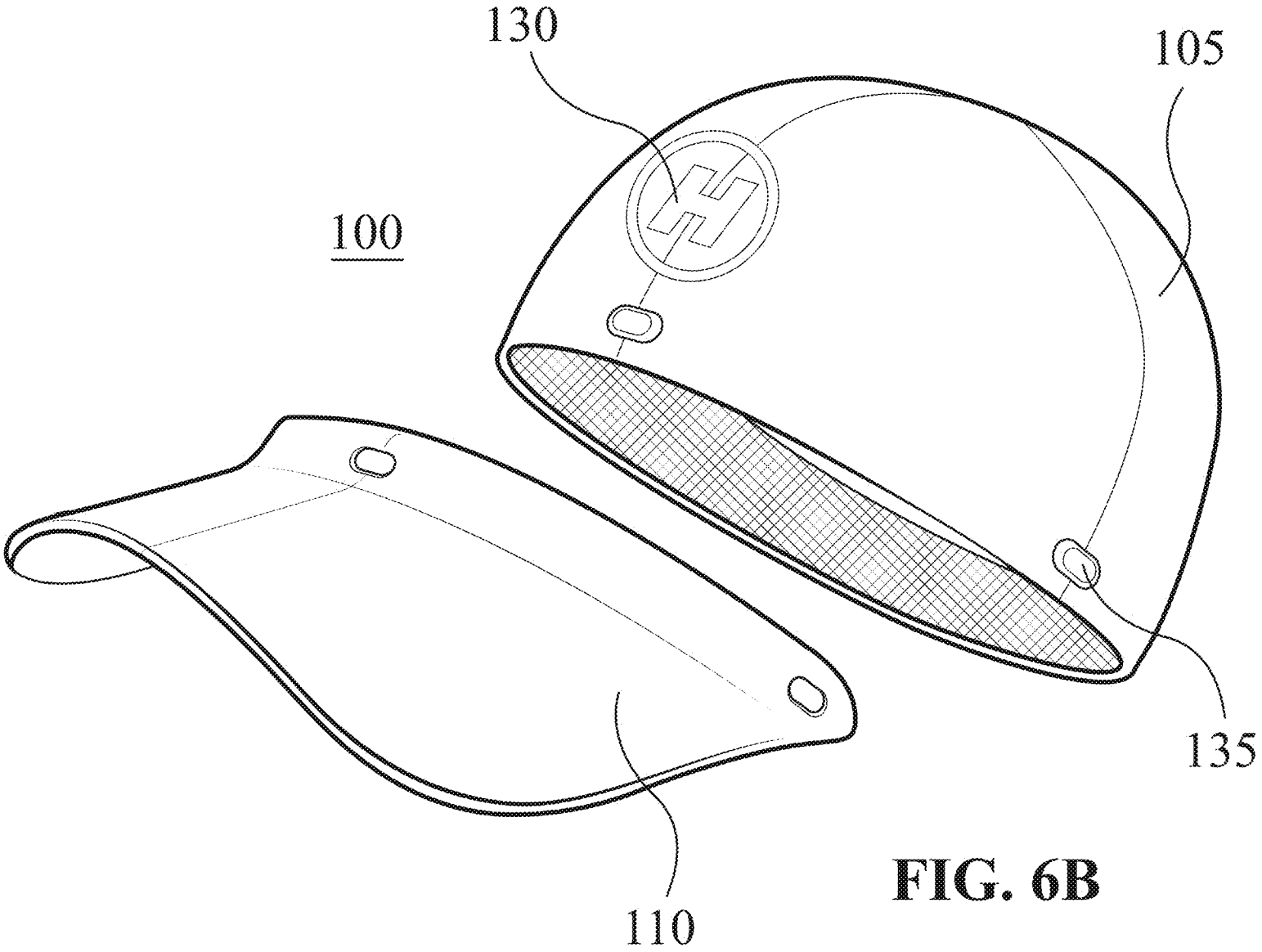
Figure 6C:
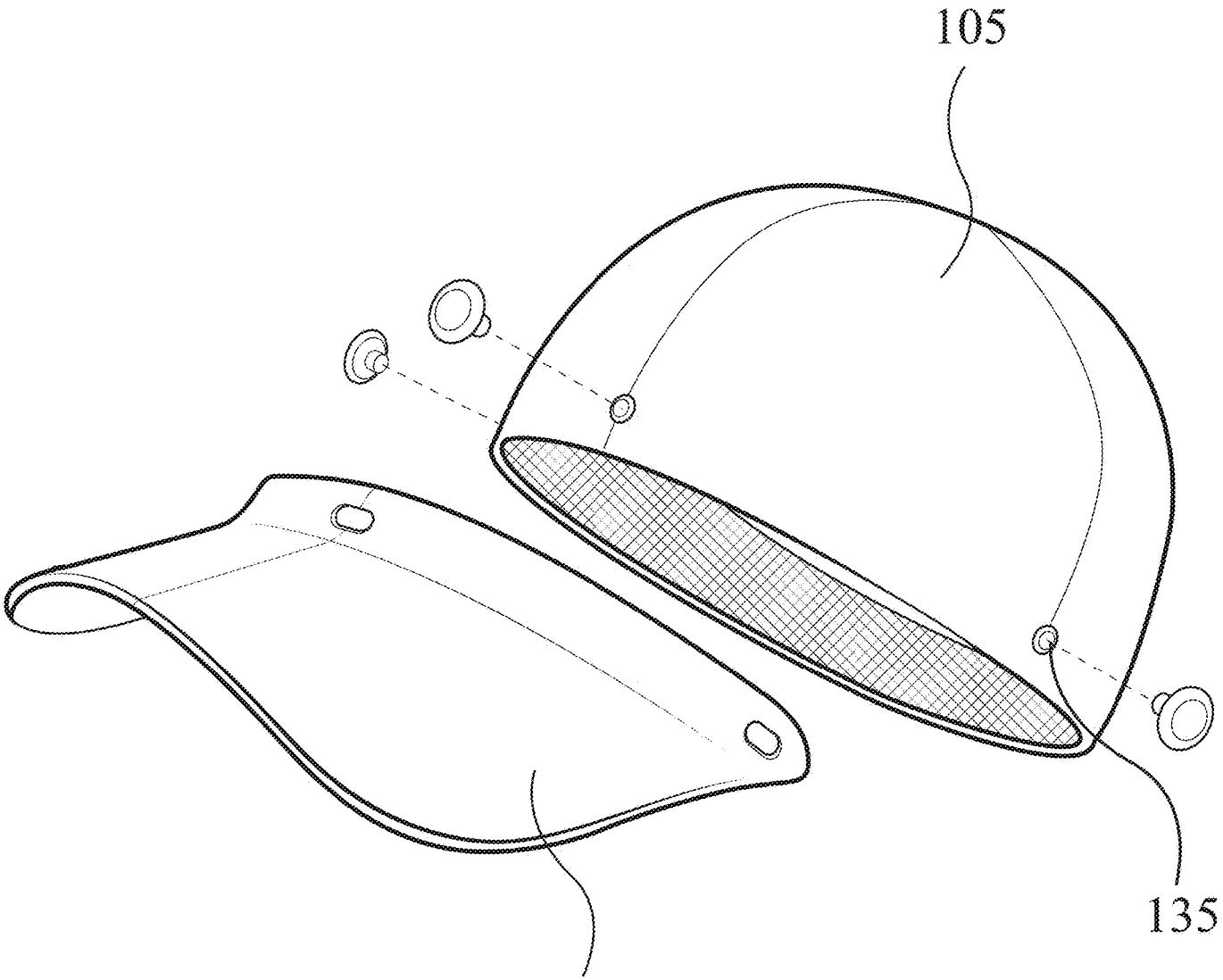
Figure 6D:
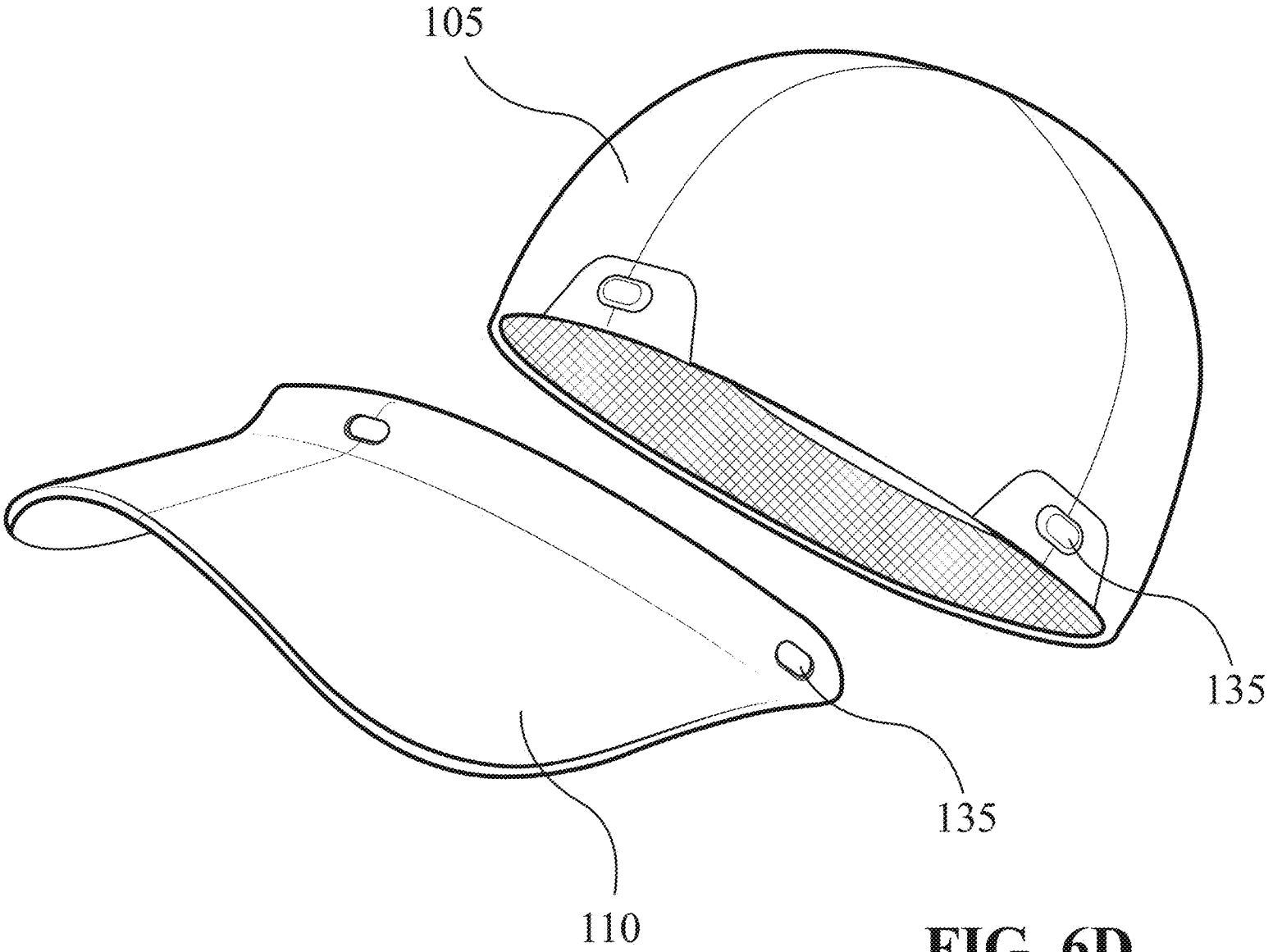
Figure 6E:
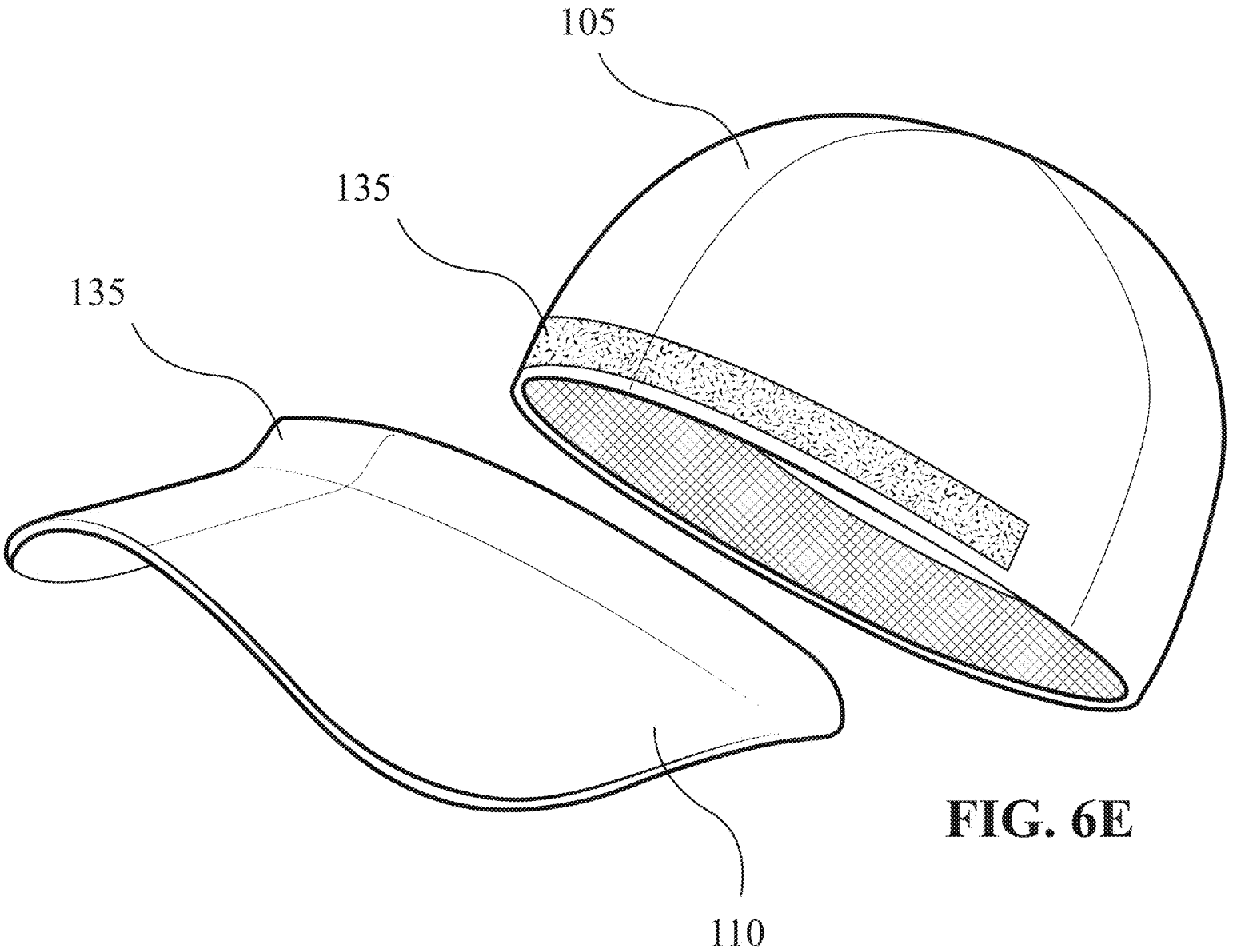
Figure 6F:
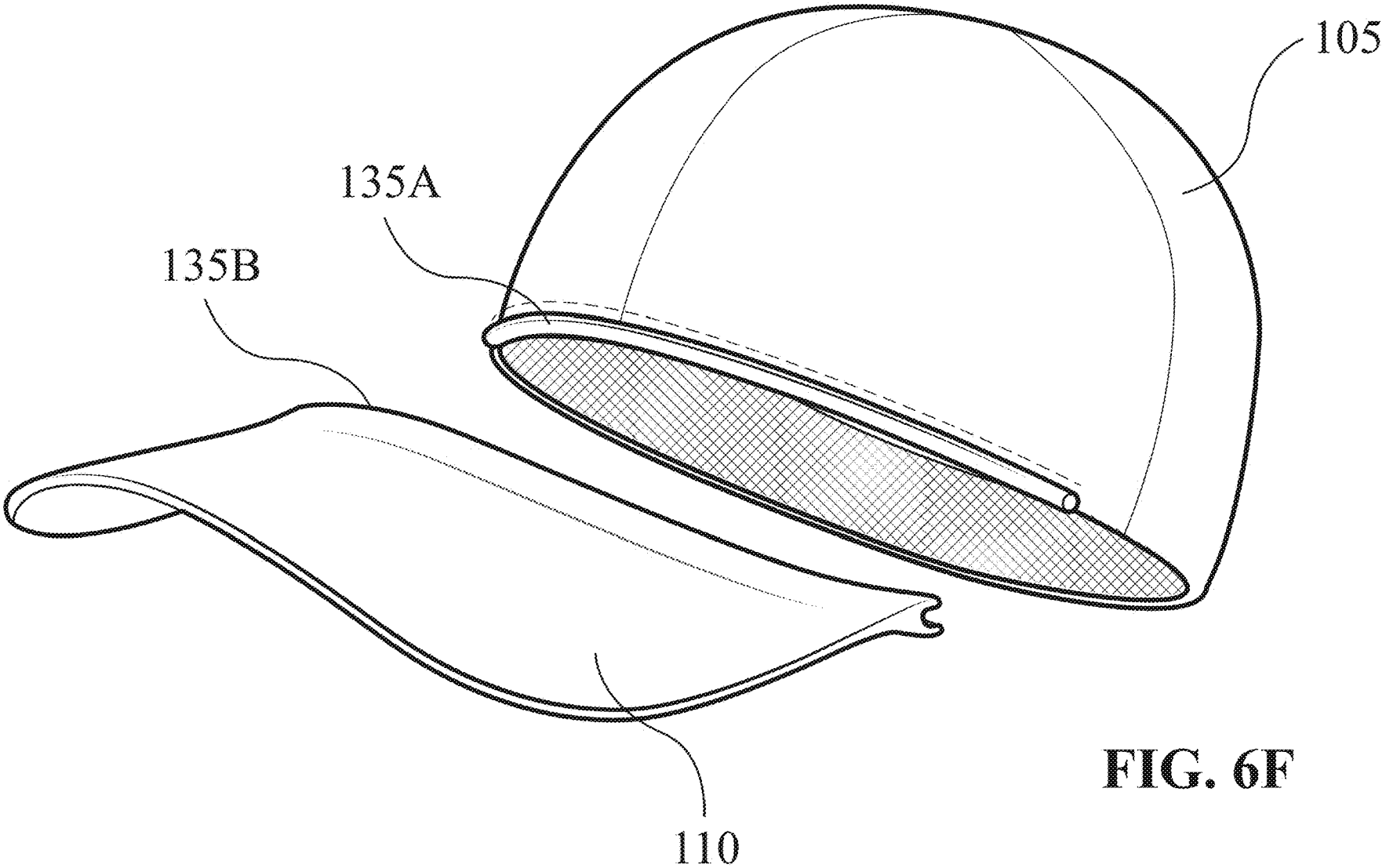
Figure 6G:
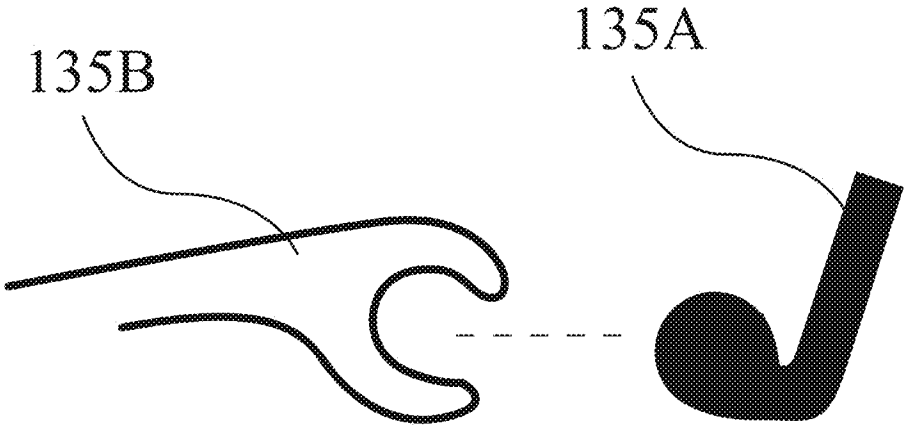
Figure 7C:
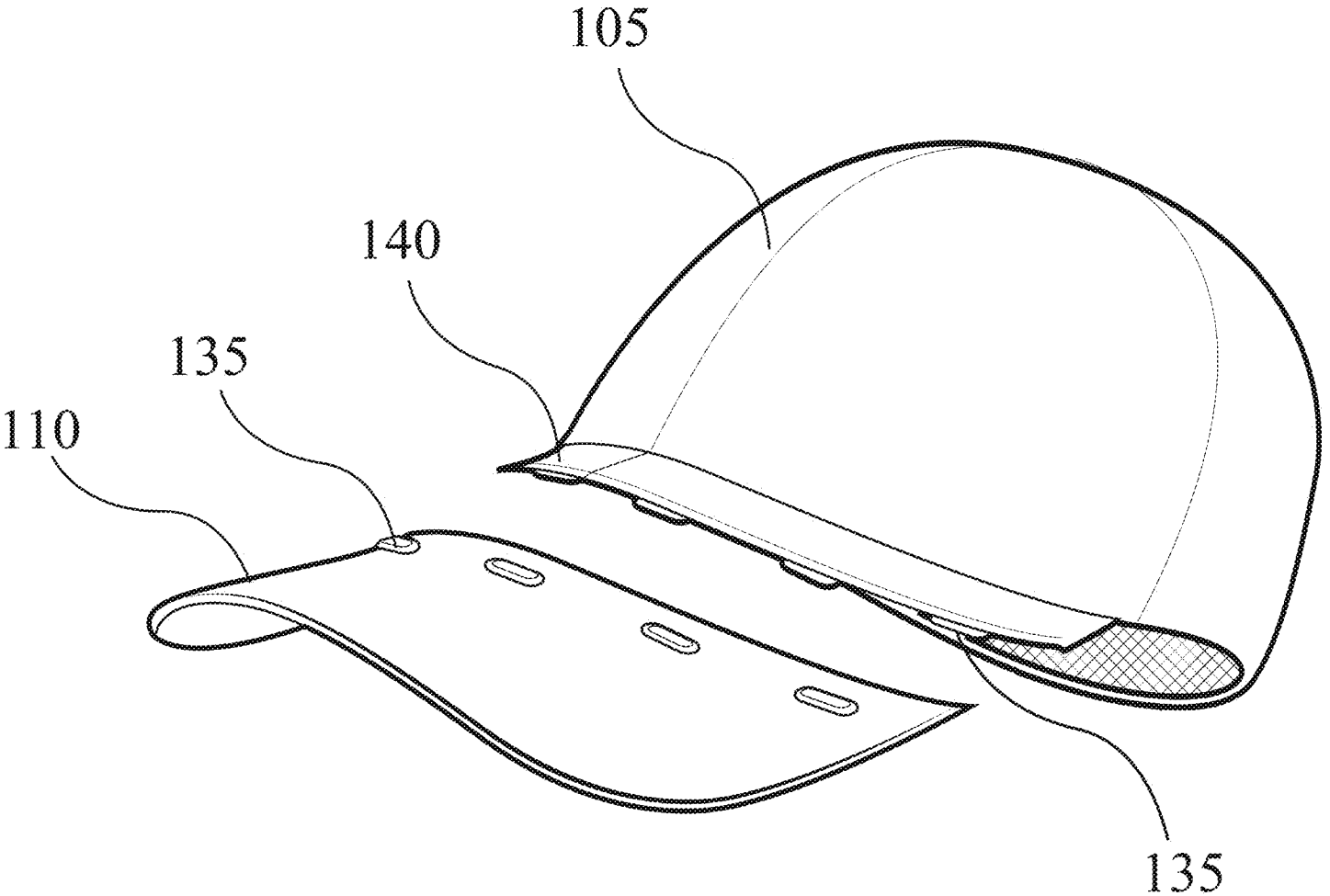
Figure 7D:
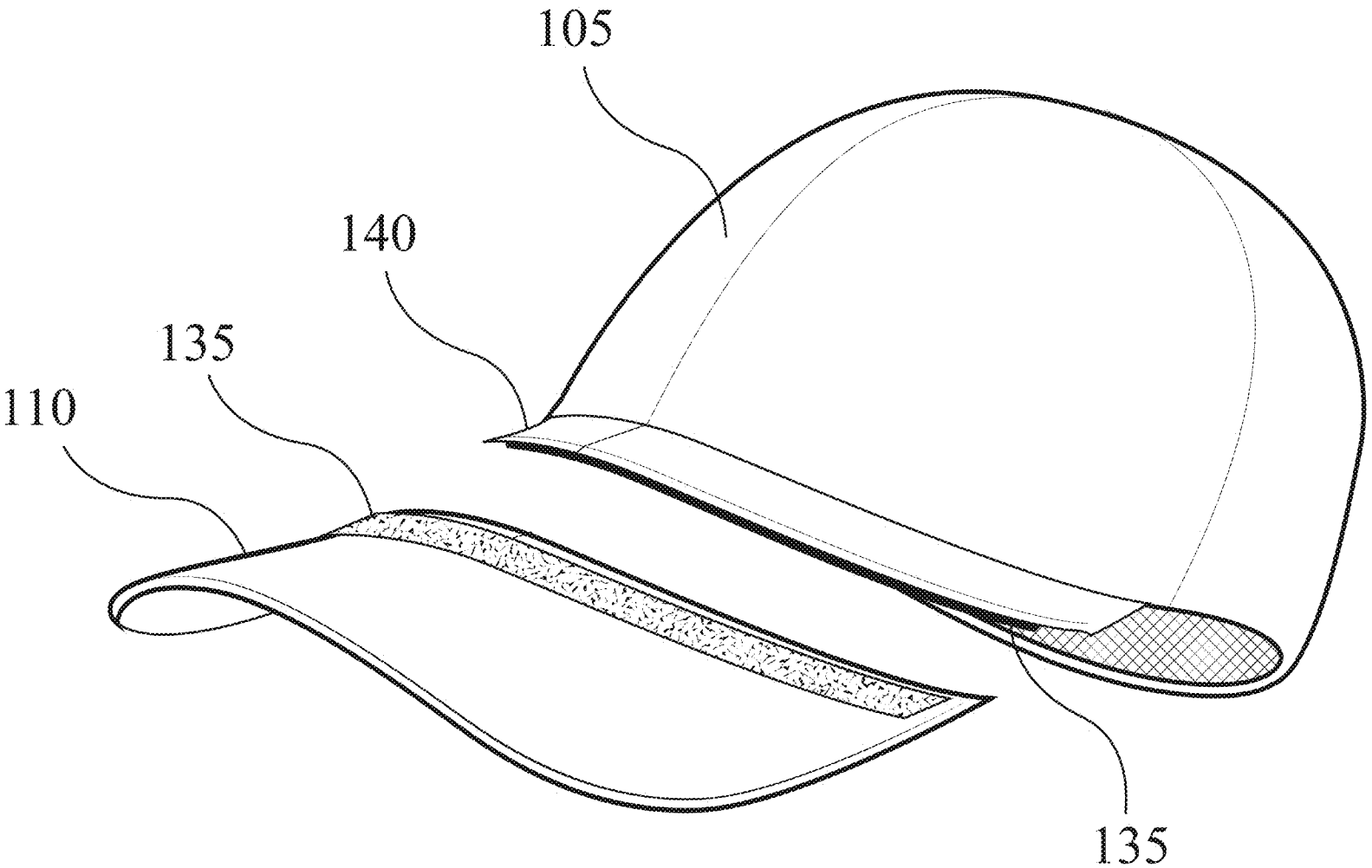
Figure 7E:
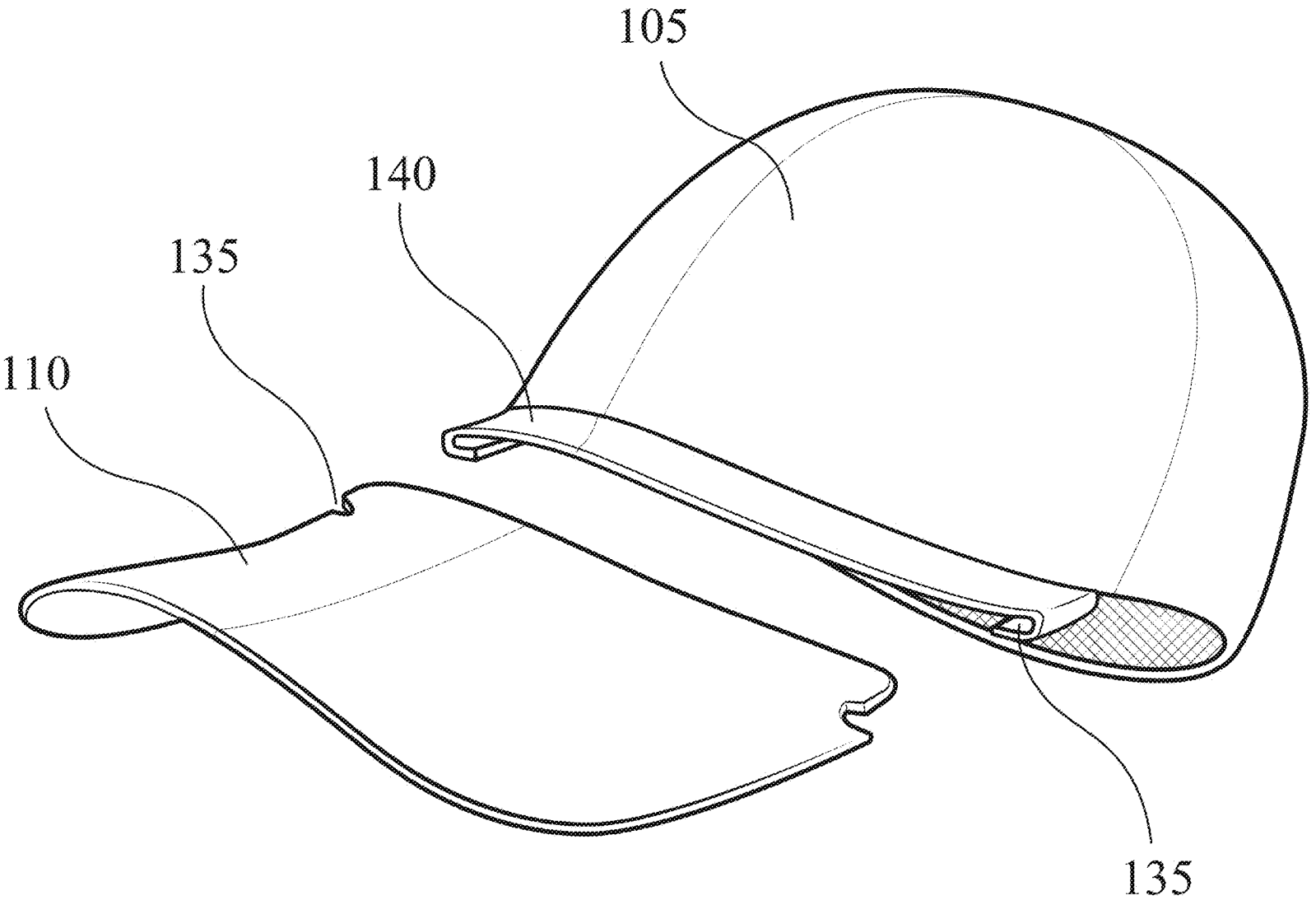

According to various embodiments, the visor 110 is permanently affixed to the cap 105. According to other embodiments, the visor 110 is removably attached to the cap (as shown in FIG. 3). According to an embodiment, the removable visor 110 is secured to the cap 105 using one or more securing mechanisms 135. According to an embodiment, the one or more securing mechanisms may include, among others, snaps or male and female snaps (as shown in FIG. 4A-FIG. 4B), molded snaps (as shown in FIG. 6A-FIG. 6B), fasteners or hook and loop fasteners (as shown in FIG. 4C, FIG. 4D, FIG. 6C, FIG. 6E, and FIG. 7D), buttons, pressure-fit systems (as shown in FIG. 7E), slot and tap systems, a clip on rail system (as shown in FIG. 6F and FIG. 6G), magnetic systems, screws, and clips. It is noted, however, that other fastening systems may be used in conjunction with the present invention, while maintaining the spirit of the present invention.

As shown in FIG. 6F and FIG. 6G, the clip on rail system may be used, which comprises a first securing mechanism 135A affixed to the cap 105 and a second securing mechanism 135B affixed to the removable visor 110. The first securing mechanism 135A may be a rail or a protrusion that extends from the cap 105. The second securing mechanism 135B may be an open slot affixed to the removable visor 110 such that the rail or protrusion may slide into the open slot to affix the cap 105 to the removable visor 110. In another embodiment, the securing mechanism may include a magnetic system. The magnetic system may include a magnetic strip or individualized and localized magnets (as shown in FIG. 6D and FIG. 7C).

According to an embodiment, the connection point between the removable visor 110 and the cap 105 may be located on the cap (as shown in FIG. 6A, FIG. 6B, FIG. 6C, FIG. 6D, FIG. 6E, FIG. 6F, and FIG. 6G). According to an embodiment, the connection point between the removable visor 110 and the cap 105 may be located on a section 140 of the visor 110 permanently affixed to the cap 105 (as shown in FIG. 3, FIG. 4C, FIG. 4D, FIG. 5A, FIG. 5B, FIG. 7A, FIG. 7B, FIG. 7C, FIG. 7D, and FIG. 7E). As shown, the section 140 extends outwardly and horizontally from a forward facing, exterior surface of the cap 105. It is further noted that the visor 110 may be coupled to the cap 105 on any suitable position on the cap 105, while maintaining the spirit of the present invention.

When introducing elements of the present disclosure or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A headwear apparatus comprising:

a cap configured to be worn on a head of a user;

a visor receiving portion extending outwardly and horizontally from a forward facing, exterior surface of the cap; and a removable visor coupled to the visor receiving portion via at least one securement mechanism, wherein the removable visor is transparent in at least one direction, and wherein the removable visor is configured to block a portion of ultraviolet rays from passing through the removable visor;

wherein the at least one securement mechanism protrudes from a bottom surface of the visor receiving portion;

wherein the removable visor has a series of apertures positioned along a peripheral edge of the removable visor and each of the series of apertures being sized to engage the at least one securement mechanism of the visor receiving portion, and wherein when the removable visor is removed from the visor receiving portion, then there is no removable visor coupled to the cap.

2. The headwear apparatus as recited in claim 1, wherein the removable visor further includes a tinting material, causing a tint of the removable visor to lighten, darken, or change between a variety of colors.

3. The headwear apparatus as recited in claim 2, wherein the tinting material is further configured to lighten or darken the tint of the removable visor according to an intensity of light hitting the removable visor.

4. The headwear apparatus as recited in claim 1, further comprising: a graphic coupled to the removable visor.

5. The headwear apparatus as recited in claim 4, wherein the graphic is transparent.

6. The headwear apparatus as recited in claim 1, wherein a top surface of the removable visor has a mirrored finish.

7. The headwear apparatus as recited in claim 1, wherein the removable visor includes an optical-grade polycarbonate.

8. A headwear apparatus comprising:

a cap configured to be worn on a head of a user;

a visor receiving portion having a first surface and a second surface, the visor receiving portion being configured to extend outwardly and horizontally from a forward facing, exterior surface of the cap, wherein the first surface is coupled to the cap and the second surface extends outwardly and horizontally away from the forward facing, exterior surface of the cap; and a removable visor coupled to the visor receiving portion via at least one securement mechanism, the at least one securement mechanism positioned on a bottom surface of the visor receiving portion, wherein the removable visor has a series of apertures positioned along a peripheral edge of the removable visor and each of the series of apertures being sized to engage the at least one securement mechanism of the visor receiving portion, wherein an entirety of the removable visor is transparent in at least one direction, and wherein the removable visor is configured to block a portion of ultraviolet rays from passing through the removable visor, wherein the at least one securement mechanism protrudes from a bottom surface of the visor receiving portion; and wherein when the removable visor is removed from the visor receiving portion, then there is no removable visor coupled to the cap.

9. The headwear apparatus as recited in claim 8, wherein the removable visor is removably secured to the visor receiving portion using more than one securement mechanism.

10. The headwear apparatus as recited in claim 9, wherein the removable visor further includes a tinting material, causing the visor to lighten, darken, or change between a variety of colors.

11. The headwear apparatus as recited in claim 10, wherein the tinting material is further configured to lighten or darken the tint of the visor according to an intensity of light hitting the removable visor.

12. The headwear apparatus as recited in claim 8, further comprising: a graphic coupled to the removable visor.

13. The headwear apparatus as recited in claim 12, wherein the graphic is transparent.

14. The headwear apparatus as recited in claim 8, wherein a top surface of the removable visor has a mirrored finish.

15. The headwear apparatus as recited in claim 8, wherein the removable visor includes an optical-grade polycarbonate.

16. The headwear apparatus as recited in claim 8, wherein only a portion of the removable visor is removable.

17. A headwear apparatus comprising:

a head receiving portion configured to be positioned on a head of a user;

a visor receiving portion extending outwardly and horizontally away from a forward facing, exterior surface of the head receiving portion, the visor receiving portion having at least one securement mechanism protruding from a bottom surface of the visor receiving portion, wherein the visor receiving portion has a first surface and a second surface with the first surface being coupled to the forward facing, exterior surface of the head receiving portion and the second surface extending outwardly and horizontally away from the forward facing, exterior surface of the head receiving portion; and a removable visor coupled to the visor receiving portion, wherein the removable visor has a series of apertures positioned along a peripheral edge of the removable visor and each of the series of apertures being sized to engage the at least one securement mechanism of the visor receiving portion, wherein the removable visor consists of a transparent material, wherein the removable visor is configured to block a portion of ultraviolet rays from passing through the removable visor; and wherein when the removable visor is removed from the visor receiving portion, then there is no removable visor coupled to the head receiving portion.

18. The headwear apparatus as recited in claim 17, wherein the removable visor is configured to reduce glare from a light source when the light source is viewed through the removable visor.

* * * * *